US008531490B2

(12) United States Patent
Harada

(10) Patent No.: US 8,531,490 B2
(45) Date of Patent: Sep. 10, 2013

(54) DISPLAY DRIVE APPARATUS AND DISPLAY APPARATUS

(75) Inventor: Takahiro Harada, Hino (JP)

(73) Assignee: Casio Computer Co., Ltd., Tokyo (JP)

( * ) Notice: Subject to any disclaimer, the term of this patent is extended or adjusted under 35 U.S.C. 154(b) by 1823 days.

(21) Appl. No.: 11/827,753

(22) Filed: Jul. 13, 2007

(65) Prior Publication Data

US 2008/0024527 A1 Jan. 31, 2008

(30) Foreign Application Priority Data

Jul. 13, 2006 (JP) ..... 2006-193041

(51) Int. Cl.
*G09G 5/10* (2006.01)

(52) U.S. Cl.
USPC ..... 345/690; 345/87

(58) Field of Classification Search
USPC ..... 345/87, 89, 690
See application file for complete search history.

(56) References Cited

U.S. PATENT DOCUMENTS

| | | | | |
|---|---|---|---|---|
| 5,777,590 | A | 7/1998 | Saxena et al. | |
| 7,382,383 | B2 | 6/2008 | Shiomi et al. | |
| 2004/0257325 | A1 * | 12/2004 | Inoue | 345/89 |

FOREIGN PATENT DOCUMENTS

| | | | |
|---|---|---|---|
| JP | 04-125588 | A | 4/1992 |
| JP | 6-57058 | | 7/1994 |
| JP | 10-143111 | A | 5/1998 |
| JP | 2003-279930 | A | 10/2003 |
| TW | 200504644 | A | 2/2005 |
| TW | 200532613 | A | 10/2005 |
| WO | WO 97/08678 | A1 | 3/1997 |

OTHER PUBLICATIONS

Taiwanese Office Action dated Feb. 16, 2012 (and English translation thereof) in counterpart Taiwanese Application No. 096125499.
Japanese Office Action (and English translation thereof) dated Aug. 19, 2008, issued in a counterpart Japanese Application.

* cited by examiner

*Primary Examiner* — Yong H Sim
(74) *Attorney, Agent, or Firm* — Holtz, Holtz, Goodman & Chick, PC

(57) ABSTRACT

A display drive apparatus drives a display panel, including display pixels, to carry out gradation display in accordance with display data. First gradation data with a first number of bits corresponding to the display data is supplied to the display drive apparatus, which generates second gradation data from the first gradation data with a second number of bits less than the first number of bits, third gradation data in which the second gradation data are eliminated from the first gradation data, and fourth gradation data corresponding to a gradation different from a gradation of the second gradation data. And, in each frame period, the display drive apparatus selectively outputs one of the second gradation data and the fourth gradation data to each of the display pixels based on the third gradation data, so as to display an intermediate gradation between the second gradation data and the fourth gradation data.

31 Claims, 12 Drawing Sheets

| 8-BIT INPUT D [7..0] | 6-BIT FRC DOUT [5..0] | GRADATION TIME AVERAGE |
|---|---|---|
| 0 | 0 | 0 |
| 1 | FRC BY 0 AND 1 | 0.25 |
| 2 | FRC BY 0 AND 1 | 0.5 |
| 3 | FRC BY 0 AND 1 | 0.75 |
| 4 | 1 | 1 |
| 5 | FRC BY 1 AND 2 | 1.25 |
| 6 | FRC BY 1 AND 2 | 1.5 |
| 7 | FRC BY 1 AND 2 | 1.75 |
| 8 | 2 | 2 |
| ... | ... | ... |
| 4n | n | n |
| 4n+1 | FRC BY n AND n+1 | n+0.25 |
| 4n+2 | FRC BY n AND n+1 | n+0.5 |
| 4n+3 | FRC BY n AND n+1 | n+0.75 |
| 4n+4 | n+1 | n+1 |
| ... | ... | ... |
| 248 | 62 | 62 |
| 249 | FRC BY 62 AND 63 | 62.25 |
| 250 | FRC BY 62 AND 63 | 62.5 |
| 251 | FRC BY 62 AND 63 | 62.75 |
| 252 | 63 | 63 |
| 253 | - | - |
| 254 | - | - |
| 255 | - | - |

FIG.3

| INPUT DATA D [7..0] | FIRST FRAME | SECOND FRAME | THIRD FRAME | FOURTH FRAME | FIFTH FRAME | SIXTH FRAME | SEVENTH FRAME | EIGHTH FRAME |
|---|---|---|---|---|---|---|---|---|
| 00h | 0000<br>0000<br>0000<br>0000 | 0000<br>0000<br>0000<br>0000 | 0000<br>0000<br>0000<br>0000 | 0000<br>0000<br>0000<br>0000 | 0000<br>0000<br>0000<br>0000 | 0000<br>0000<br>0000<br>0000 | 0000<br>0000<br>0000<br>0000 | 0000<br>0000<br>0000<br>0000 |
| 01h | 0100<br>1000<br>0001<br>0010 | 0001<br>0010<br>0100<br>1000 | 0010<br>0001<br>1000<br>0100 | 1000<br>0100<br>0010<br>0001 | 0001<br>0010<br>0100<br>1000 | 0100<br>1000<br>0001<br>0010 | 1000<br>0100<br>0010<br>0001 | 0010<br>0001<br>1000<br>0100 |
| 02h | 0101<br>1010<br>0101<br>1010 | 0101<br>1010<br>0101<br>1010 | 1010<br>0101<br>1010<br>0101 | 1010<br>0101<br>1010<br>0101 | 0101<br>1010<br>0101<br>1010 | 0101<br>1010<br>0101<br>1010 | 1010<br>0101<br>1010<br>0101 | 1010<br>0101<br>1010<br>0101 |
| 03h | 1101<br>1110<br>0111<br>1011 | 0111<br>1011<br>1101<br>1110 | 1011<br>0111<br>1110<br>1101 | 1110<br>1101<br>1011<br>0111 | 0111<br>1011<br>1101<br>1110 | 1101<br>1110<br>0111<br>1011 | 1110<br>1101<br>1011<br>0111 | 1011<br>0111<br>1110<br>1101 |
| 04h | 1111<br>1111<br>1111<br>1111 | 1111<br>1111<br>1111<br>1111 | 1111<br>1111<br>1111<br>1111 | 1111<br>1111<br>1111<br>1111 | 1111<br>1111<br>1111<br>1111 | 1111<br>1111<br>1111<br>1111 | 1111<br>1111<br>1111<br>1111 | 1111<br>1111<br>1111<br>1111 |

FIG.4A

INPUT DATA D [7..0]=02h

| | | | |
|---|---|---|---|
| 1 | 0 | 1 | 0 |
| 0 | 1 | 0 | 1 |
| 1 | 0 | 1 | 0 |
| 0 | 1 | 0 | 1 |

→ 0.5

OR

| | | | |
|---|---|---|---|
| 0 | 1 | 0 | 1 |
| 1 | 0 | 1 | 0 |
| 0 | 1 | 0 | 1 |
| 1 | 0 | 1 | 0 |

→ 0.5

FIG.4B

INPUT DATA D [7..0]=02h

| | |
|---|---|
| 0.5 | 0.5 |
| 0.5 | 0.5 |

FIG.4C

INPUT DATA D [7..0]=01h

| | |
|---|---|
| 0.5 | 0 |
| 0 | 0.5 |

OR

| | |
|---|---|
| 0 | 0.5 |
| 0.5 | 0 |

FIG.8

| INPUT DATA D [7..0] | FIRST FRAME | SECOND FRAME | THIRD FRAME | FOURTH FRAME | FIFTH FRAME | SIXTH FRAME | SEVENTH FRAME | EIGHTH FRAME |
|---|---|---|---|---|---|---|---|---|
| 00h | 0 0 0 0 0 0<br>0 0 0 0 0 0<br>0 0 0 0 0 0<br>0 0 0 0 0 0 | 0 0 0 0 0 0<br>0 0 0 0 0 0<br>0 0 0 0 0 0<br>0 0 0 0 0 0 | 0 0 0 0 0 0<br>0 0 0 0 0 0<br>0 0 0 0 0 0<br>0 0 0 0 0 0 | 0 0 0 0 0 0<br>0 0 0 0 0 0<br>0 0 0 0 0 0<br>0 0 0 0 0 0 | 0 0 0 0 0 0<br>0 0 0 0 0 0<br>0 0 0 0 0 0<br>0 0 0 0 0 0 | 0 0 0 0 0 0<br>0 0 0 0 0 0<br>0 0 0 0 0 0<br>0 0 0 0 0 0 | 0 0 0 0 0 0<br>0 0 0 0 0 0<br>0 0 0 0 0 0<br>0 0 0 0 0 0 | 0 0 0 0 0 0<br>0 0 0 0 0 0<br>0 0 0 0 0 0<br>0 0 0 0 0 0 |
| 01h | 1 0 1 0 0 0<br>0 1 0 0 0 0<br>0 0 0 0 1 0<br>0 0 0 1 0 1 | 0 0 0 0 1 0<br>0 0 0 1 0 1<br>1 0 1 0 0 0<br>0 1 0 0 0 0 | 0 1 0 0 0 0<br>1 0 1 0 0 0<br>0 0 0 1 0 1<br>0 0 0 0 1 0 | 0 0 0 1 0 1<br>0 0 0 0 1 0<br>0 1 0 0 0 0<br>1 0 1 0 0 0 | 0 0 0 0 1 0<br>0 0 0 1 0 1<br>1 0 1 0 0 0<br>0 1 0 0 0 0 | 1 0 1 0 0 0<br>0 1 0 0 0 0<br>0 0 0 0 1 0<br>0 0 0 1 0 1 | 0 0 0 1 0 1<br>0 0 0 0 1 0<br>0 1 0 0 0 0<br>1 0 1 0 0 0 | 0 1 0 0 0 0<br>1 0 1 0 0 0<br>0 0 0 1 0 1<br>0 0 0 0 1 0 |
| 02h | 1 0 1 0 1 0<br>0 1 0 1 0 1<br>1 0 1 0 1 0<br>0 1 0 1 0 1 | 1 0 1 0 1 0<br>0 1 0 1 0 1<br>1 0 1 0 1 0<br>0 1 0 1 0 1 | 0 1 0 1 0 1<br>1 0 1 0 1 0<br>0 1 0 1 0 1<br>1 0 1 0 1 0 | 0 1 0 1 0 1<br>1 0 1 0 1 0<br>0 1 0 1 0 1<br>1 0 1 0 1 0 | 1 0 1 0 1 0<br>0 1 0 1 0 1<br>1 0 1 0 1 0<br>0 1 0 1 0 1 | 1 0 1 0 1 0<br>0 1 0 1 0 1<br>1 0 1 0 1 0<br>0 1 0 1 0 1 | 0 1 0 1 0 1<br>1 0 1 0 1 0<br>0 1 0 1 0 1<br>1 0 1 0 1 0 | 0 1 0 1 0 1<br>1 0 1 0 1 0<br>0 1 0 1 0 1<br>1 0 1 0 1 0 |
| 03h | 1 1 1 1 0 1 0<br>1 1 1 1 1 0 1<br>1 0 1 1 1 1 1<br>0 1 0 1 1 1 1 | 1 0 1 1 1 1 1<br>0 1 0 1 1 1 1<br>1 1 1 0 1 0<br>1 1 1 1 0 1 | 0 1 1 1 0 1<br>1 1 1 0 1 0<br>0 1 0 1 1 1<br>1 0 1 1 1 1 | 0 1 0 1 1 1<br>1 0 1 1 1 1<br>1 1 1 1 0 1<br>1 1 1 0 1 0 | 1 0 1 1 1 1<br>0 1 0 1 1 1<br>1 1 1 0 1 0<br>1 1 1 1 0 1 | 1 1 1 0 1 0<br>1 1 1 1 0 1<br>1 0 1 1 1 1<br>0 1 0 1 1 1 | 0 1 0 1 1 1<br>1 0 1 1 1 1<br>1 1 1 1 0 1<br>1 1 1 0 1 0 | 1 1 1 1 0 1<br>1 1 1 0 1 0<br>0 1 0 1 1 1<br>1 0 1 1 1 1 |
| 04h | 1 1 1 1 1 1<br>1 1 1 1 1 1<br>1 1 1 1 1 1<br>1 1 1 1 1 1 | 1 1 1 1 1 1<br>1 1 1 1 1 1<br>1 1 1 1 1 1<br>1 1 1 1 1 1 | 1 1 1 1 1 1<br>1 1 1 1 1 1<br>1 1 1 1 1 1<br>1 1 1 1 1 1 | 1 1 1 1 1 1<br>1 1 1 1 1 1<br>1 1 1 1 1 1<br>1 1 1 1 1 1 | 1 1 1 1 1 1<br>1 1 1 1 1 1<br>1 1 1 1 1 1<br>1 1 1 1 1 1 | 1 1 1 1 1 1<br>1 1 1 1 1 1<br>1 1 1 1 1 1<br>1 1 1 1 1 1 | 1 1 1 1 1 1<br>1 1 1 1 1 1<br>1 1 1 1 1 1<br>1 1 1 1 1 1 | 1 1 1 1 1 1<br>1 1 1 1 1 1<br>1 1 1 1 1 1<br>1 1 1 1 1 1 |

FIG.10

| INPUT DATA D [7..0] | FIRST FRAME | SECOND FRAME | THIRD FRAME | FOURTH FRAME | FIFTH FRAME | SIXTH FRAME | SEVENTH FRAME | EIGHTH FRAME |
|---|---|---|---|---|---|---|---|---|
| 00h | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 |
| 01h | 0 1 0 0<br>1 0 0 0<br>0 0 0 1<br>0 0 1 0 | 0 0 0 1<br>0 0 1 0<br>0 1 0 0<br>1 0 0 0 | 0 0 0 1<br>0 0 1 0<br>0 1 0 0<br>1 0 0 0 | 0 1 0 0<br>1 0 0 0<br>0 0 0 1<br>0 0 1 0 | 1 0 0 0<br>0 1 0 0<br>0 0 1 0<br>0 0 0 1 | 0 0 1 0<br>0 0 0 1<br>1 0 0 0<br>0 1 0 0 | 0 0 1 0<br>0 0 0 1<br>1 0 0 0<br>0 1 0 0 | 1 0 0 0<br>0 1 0 0<br>0 0 1 0<br>0 0 0 1 |
| 02h | 0 1 0 1<br>1 0 1 0<br>0 1 0 1<br>1 0 1 0 | 0 1 0 1<br>1 0 1 0<br>0 1 0 1<br>1 0 1 0 | 0 1 0 1<br>1 0 1 0<br>0 1 0 1<br>1 0 1 0 | 0 1 0 1<br>1 0 1 0<br>0 1 0 1<br>1 0 1 0 | 1 0 1 0<br>0 1 0 1<br>1 0 1 0<br>0 1 0 1 | 1 0 1 0<br>0 1 0 1<br>1 0 1 0<br>0 1 0 1 | 1 0 1 0<br>0 1 0 1<br>1 0 1 0<br>0 1 0 1 | 1 0 1 0<br>0 1 0 1<br>1 0 1 0<br>0 1 0 1 |
| 03h | 1 1 0 1<br>1 1 1 0<br>0 1 1 1<br>1 0 1 1 | 0 1 1 1<br>1 0 1 1<br>1 1 0 1<br>1 1 1 0 | 0 1 1 1<br>1 0 1 1<br>1 1 0 1<br>1 1 1 0 | 1 1 0 1<br>1 1 1 0<br>0 1 1 1<br>1 0 1 1 | 1 1 1 0<br>1 1 0 1<br>1 0 1 1<br>0 1 1 1 | 1 0 1 1<br>0 1 1 1<br>1 1 1 0<br>1 1 0 1 | 1 0 1 1<br>0 1 1 1<br>1 1 1 0<br>1 1 0 1 | 1 1 1 0<br>1 1 0 1<br>1 0 1 1<br>0 1 1 1 |
| 04h | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 |

FIG.12

| INPUT DATA D [7..0] | FIRST FRAME | SECOND FRAME | THIRD FRAME | FOURTH FRAME | FIFTH FRAME | SIXTH FRAME | SEVENTH FRAME | EIGHTH FRAME |
|---|---|---|---|---|---|---|---|---|
| 00h | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 | 0 0 0 0<br>0 0 0 0<br>0 0 0 0<br>0 0 0 0 |
| 01h | 0 0 1 0<br>0 0 0 1<br>1 0 0 0<br>0 1 0 0 | 0 0 0 1<br>0 0 1 0<br>0 1 0 0<br>1 0 0 0 | 1 0 0 0<br>0 1 0 0<br>0 0 1 0<br>0 0 0 1 | 0 1 0 0<br>1 0 0 0<br>0 0 0 1<br>0 0 1 0 | 0 0 0 1<br>0 0 1 0<br>0 1 0 0<br>1 0 0 0 | 0 0 1 0<br>0 0 0 1<br>1 0 0 0<br>0 1 0 0 | 0 1 0 0<br>1 0 0 0<br>0 0 0 1<br>0 0 1 0 | 1 0 0 0<br>0 1 0 0<br>0 0 1 0<br>0 0 0 1 |
| 02h | 1 0 1 0<br>0 1 0 1<br>1 0 1 0<br>0 1 0 1 | 0 1 0 1<br>1 0 1 0<br>0 1 0 1<br>1 0 1 0 | 1 0 1 0<br>0 1 0 1<br>1 0 1 0<br>0 1 0 1 | 0 1 0 1<br>1 0 1 0<br>0 1 0 1<br>1 0 1 0 | 0 1 0 1<br>1 0 1 0<br>0 1 0 1<br>1 0 1 0 | 1 0 1 0<br>0 1 0 1<br>1 0 1 0<br>0 1 0 1 | 0 1 0 1<br>1 0 1 0<br>0 1 0 1<br>1 0 1 0 | 1 0 1 0<br>0 1 0 1<br>1 0 1 0<br>0 1 0 1 |
| 03h | 1 0 1 1<br>0 1 1 1<br>1 1 1 0<br>1 1 0 1 | 0 1 1 1<br>1 0 1 1<br>1 1 0 1<br>1 1 1 0 | 1 1 1 0<br>1 1 0 1<br>1 0 1 1<br>0 1 1 1 | 1 1 0 1<br>1 1 1 0<br>0 1 1 1<br>1 0 1 1 | 1 0 1 1<br>0 1 1 1<br>1 1 0 1<br>1 1 1 0 | 1 0 1 1<br>0 1 1 1<br>1 1 1 0<br>1 1 0 1 | 1 1 0 1<br>1 1 1 0<br>0 1 1 1<br>1 0 1 1 | 1 1 1 0<br>1 1 0 1<br>1 0 1 1<br>0 1 1 1 |
| 04h | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 | 1 1 1 1<br>1 1 1 1<br>1 1 1 1<br>1 1 1 1 |

DISPLAY DRIVE APPARATUS AND DISPLAY APPARATUS

CROSS-REFERENCE TO RELATED APPLICATIONS

This application is based upon and claims the benefit of priority of prior Japanese Patent Application No. 2006-193041, filed Jul. 13, 2006, the entire contents of which are incorporated herein by reference.

BACKGROUND OF THE INVENTION

1. Field of the Invention

The present invention relates to a display drive apparatus capable of carrying out gradation display by a frame rate control (FRC) method, and a display apparatus including the same.

2. Description of the Related Art

Conventionally, a frame rate control (FRC) method ("FRC drive") has been known as one of the methods for carrying out gradation display on a display apparatus such as a liquid crystal display. The FRC method is a method in which a display drive apparatus capable of carrying out display in predetermined gradations carries out display in multiple gradations more than the predetermined gradations. This FRC method is a method in which several frames are set as one cycle, and a halftone is obtained by temporally changing gradations of respective pixels in this one cycle.

Here, in FRC drive, flicker is easily caused at the time of carrying out halftone display. Therefore, in FRC drive, it is ideal to carry out display in multiple gradations by replacing data of frames and at a display position, and to suppress flicker as much as possible. However, there occur images in which flicker is easily brought about by driving at any means, and it is generally thought to be difficult to suppress flicker in every image.

As means for suppressing such flicker, there have been proposed a method in which a large number of look-up tables are provided in advance, drive display is carried out by randomly selecting a look-up table. In addition, a method has been proposed in which FRC patterns based on which flicker is hard to occur are prepared before and after frame frequency conversion with respect to input gradation data, and display drive is carried out in accordance with these FRC patterns, and the like.

Here, in the method in which look-up tables are provided in advance, or in the method in which FRC patterns are generated based on which flicker is hard to occur, the effect of preventing flicker from occurring is high. However, a storage unit dedicated for storing the look-up tables is required, or it is necessary to prepare FRC patterns before and after frame frequency conversion, which is more likely to make a circuit structure and a drive method complicated.

SUMMARY OF THE INVENTION

In a display drive apparatus capable of carrying out gradation display by a frame rate control method and a display apparatus including the same, the present invention has the advantage that it is possible to provide a display drive apparatus capable of carrying out satisfactory gradation display by preventing flicker from occurring with a simplified circuit structure and drive method, and a display apparatus including the same.

In order to achieve the above advantage, one aspect the present invention provides a display drive apparatus which drives a display panel in which a plurality of display pixels are arrayed. The display drive apparatus includes: a first gradation signal generating circuit to which first gradation data with a first number of bits corresponding to display data are supplied, and which generates: (i) second gradation data with a second number of bits, which is less than the first number of bits, from the first gradation data, and (ii) third gradation data in which the second gradation data are eliminated from the first gradation data; a second gradation signal generating circuit which generates, from the second gradation data, fourth gradation data corresponding to a gradation different from a gradation of the second gradation data; and an output circuit which, in each frame period of display by the display panel, selectively outputs one of the second gradation data and the fourth gradation data to each of the display pixels of the display panel based on the third gradation data, so as to cause an intermediate gradation between the second gradation data and the fourth gradation data to be displayed on the display panel.

According to another aspect of the present invention, a display apparatus is provided which displays image information based on display data. The display apparatus includes: display means, comprising a display panel in which a plurality of display pixels are arrayed vertically and horizontally, for carrying out display by setting each of the display pixels to display a respective gradation corresponding to supplied gradation data; a first gradation signal generating circuit to which first gradation data with a first number of bits corresponding to the display data are supplied, and which generates: (i) second gradation data with a second number of bits, which is less than the first number of bits, from the first gradation data, and (ii) third gradation data in which the second gradation data are eliminated from the first gradation data; a second gradation signal generating circuit which generates, from the second gradation data, fourth gradation data corresponding to a gradation different from a gradation of the second gradation data; and an output circuit which, in each frame period of display by the display means, selectively outputs one of the second gradation data and the fourth gradation data to each of the display pixels of the display means as the supplied gradation data, based on the third gradation data, so as to set each of the display pixels to be one of a gradation corresponding to the second gradation data and a gradation corresponding to the fourth gradation data every frame period, so as to cause an intermediate gradation between the second gradation data and the fourth gradation data to be displayed on the display panel.

According to a further aspect of the present invention, a method is provided for driving a display apparatus which displays image information based on display data, wherein the display apparatus includes a display panel in which a plurality of display pixels are arrayed vertically and horizontally. The method includes: supplying first gradation data with a first number of bits corresponding to the display data to the display apparatus; generating second gradation data with a second number of bits, which is less than the first number of bits, from the first gradation data; generating third gradation data in which the second gradation data are eliminated from the first gradation data; generating, from the second gradation data, fourth gradation data corresponding to a gradation different from a gradation of the second gradation data; selecting, in each frame period of display by the display panel of a predetermined plurality of frame periods, one of the second gradation data and the fourth gradation data to be applied to each of the display pixels of the display panel, based on the third gradation data; and setting, in each frame period, each of the display pixels to be one of a gradation corresponding to the second gradation data and a gradation corresponding to the fourth gradation data, so as to display an intermediate gradation between the second gradation data and the fourth gradation data on the display panel.

BRIEF DESCRIPTION OF THE DRAWINGS

FIG. 3 is a diagram showing the concept of FRC drive corresponding to the respective cases when input data D [7 . . . 0] are 0 to 4;

FIGS. 4A, 4B, and 4C are diagrams showing the ideas of the display of gradation levels 0 and 1 in a case of the input data D [7 . . . 0]=01h;

FIG. 8 is a diagram showing the concept of FRC drive when a small display area is three pixels×two pixels;

FIG. 10 is a diagram showing a status of gradation display when the logic circuit unit corresponds to the first modification;

FIG. 12 is a diagram showing a status of gradation display when the logic circuit unit corresponds to the second modification.

DETAILED DESCRIPTION OF THE PREFERRED EMBODIMENTS

Figures 1, 2:
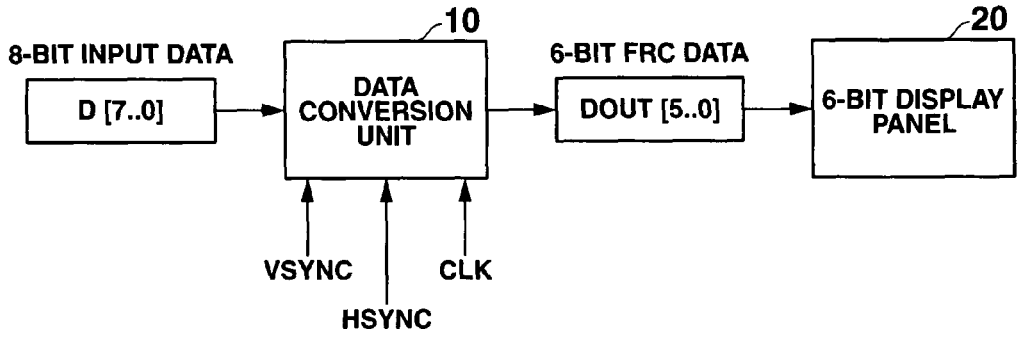
FIG. 1 is a diagram showing a principal structure for carrying out an FRC method in the present embodiment.
FIG. 2 is a table showing relationships among input data, FRC data, and a time average of gradation levels (gradation time average) per cycle of respective display pixels of a display panel module.

Hereinafter, a display drive apparatus and a display apparatus including the same according to the present invention will be described in detail on the basis of an embodiment shown in the drawings.

FIG. 1 is a diagram showing a principal structure for carrying out an FRC method of the present embodiment.

Note that, in the present embodiment, an example in which gradation display is carried out on a 6-bit display panel on the basis of 8-bit input data will be described.

As shown in FIG. 1, the display apparatus of the present embodiment mainly comprises a data conversion unit 10 and a display panel module 20.

The data conversion unit 10 includes a first gradation signal generating circuit, a second gradation signal generating circuit, an output circuit, and a timing setting circuit, and converts input data (first gradation data) D [7 . . . 0] of 8 bits (a first number of bits) into FRC data (second and fourth gradation data) DOUT [5 . . . 0] of 6 bits (a second number of bits) which can be displayed on the display panel module 20, and outputs the FRC data DOUT [5 . . . 0] to the display panel module 20 in predetermined timings corresponding to the statuses of inputting of a vertical synchronizing signal VSYNC, a horizontal synchronizing signal HSYNC, and clock signal CLK.

The vertical synchronizing signal VSYNC is a synchronizing signal for informing a timing to start display driving of one frame in the display panel module 20. The horizontal synchronizing signal HSYNC is a synchronizing signal for informing a timing to start display driving of one line in the display panel module 20. And the clock signal CLK is a synchronizing signal for informing a timing to start display driving of one display pixel in the display panel module 20.

The display panel module 20 (FIG. 1) includes a display panel unit, a scanning line drive circuit, and a signal line drive circuit (which are not shown), and serves as display means in the present invention.

The display panel unit includes a plurality of scanning lines allocated in rows, and a plurality of signal lines allocated in columns in, for example, an active-matrix system, and display pixels are provided in the vicinities of the respective intersecting points of the scanning lines and the signal lines. The scanning line drive circuit sets the display pixels to be sequentially in a selected state by sequentially outputting scanning signals for driving the scanning lines of the display panel unit in timings synchronized with vertical synchronizing signals VSYNC and horizontal synchronizing signals HSYNC.

The signal line drive circuit is capable of generating gradation voltages corresponding to all of the gradation levels (64 gradations from 0 to 63) which can be specified by the 6-bit FRC data DOUT [5 . . . 0].

The signal line drive circuit retrieves the FRC data DOUT [5 . . . 0] from the data conversion unit 10 in timings synchronized with clock signals CLK, and selects gradation voltages corresponding to the retrieved FRC data DOUT [5 . . . 0] to be outputted to the respective display pixels of the display panel unit.

In the case of a liquid crystal display, each display pixel is structured such that a liquid crystal is filled between a pixel electrode to which a gradation voltage is applied, and a counter electrode which is disposed to face the pixel electrode and to which a common voltage is applied. In such a structure, a voltage corresponding to a difference between the gradation voltage and the common voltage is applied to the liquid crystal by applying a gradation voltage to the pixel electrode. In accordance therewith, image display is carried out.

Hereinafter, FRC drive in the present embodiment will be described.

FIG. 2 is a table showing relationships among input data, FRC data, and a time average of gradation levels (gradation time average) per cycle of each display pixel of a display panel module.

By carrying out FRC drive so as to satisfy relationships as shown in FIG. 2, it is possible to display 253 gradations corresponding to the 8-bit input data on the 6-bit display panel module 20. Note that in FIG. 2, it is impossible to display the gradation levels 253, 254, and 255 of the 8-bit input data D [7 . . . 0]. This is because the display panel module 20 is only capable of displaying 6 bits.

Accordingly, in order to make it possible to display the gradation levels 253, 254, and 255, the display panel module 20 may be configured to be able to carry out display corresponding to the gradation level 64, and FRC data are set to be 7 bits, which makes it possible to display all the gradations expressed by the 8-bit input data.

As shown in FIG. 2, in the present embodiment, the FRC drive that is carried out differs depending on whether the input data D [7 . . . 0] is 4n, 4n+1, 4n+2, or 4n+3 (where n is an integer from 0 to 63).

First, when the input data D [7 . . . 0] is 4n (0, 4, 8, 248, and 252), only the FRC data DOUT [5 . . . 0]=n is inputted to the signal line drive circuit of the display panel module 20, and FRC drive is carried out such that a gradation time average of the respective display pixels is driven at a gradation level n.

When the input data D [7 . . . 0] is 4n+1 (1, 5, 9, . . . , and 249), the FRC data DOUT [5 . . . 0]=n and the FRC data DOUT [5 . . . 0]=n+1 are selectively inputted to the signal line drive circuit of the display panel module 20, and FRC drive is carried out such that a gradation time average of the respective display pixels is driven at a gradation level n+0.25. Namely, because it is impossible to simply carry out display of the halftone between the gradation levels n and n+1, the display of the halftone is carried out by driving one display pixel at the gradation levels n and n+1, which is defined as a time average.

When the input data D [7 . . . 0] is 4n+2 (2, 6, 10, and 250), the FRC data DOUT [5 . . . 0]=n and the FRC data DOUT [5 . . . 0]=n+1 are selectively inputted to the signal line drive circuit of the display panel module 20, and FRC drive is carried out such that a gradation time average of the respective display pixels is driven at a gradation level n+0.5.

When the input data D [7 . . . 0] is 4n+3 (3, 7, 11, and 251), the FRC data DOUT [5 . . . 0]=n and the FRC data DOUT [5 . . . 0]=n+1 are selectively inputted to the signal line drive circuit of the display panel module 20, and FRC drive is carried out such that a gradation time average of the respective display pixels is driven at a gradation level n+0.75.

FIG. 3 is a diagram showing the concept of FRC drive using the cases when the input data D [7 . . . 0] are 0 to 4, respectively, as examples.

As shown in FIG. 3, in FRC drive in the present embodiment, a display is carried out per cycle, which is 8 frames. By carrying out FRC drive as shown in FIG. 3, it is possible to carry out multi-gradation display by the signal line drive circuit with a small number of bits, and it is possible to suppress flicker, particularly in a longitudinal direction and a transverse direction in a screen.

In the present embodiment, on the assumption that two pixels×two pixels is one small display area, the display pixels are arrayed two by two in a longitudinal direction and a transverse direction, thereby forming a unit of four pixels× four pixels. Then, a display is carried out by changing the gradation levels of the respective display pixels within the unit of four pixels×four pixels every frame. Note that only one unit of four pixels×four pixels is shown in FIG. 3. However, in practice, the screen of the display panel module 20 is structured by arranging a plurality of the units of four pixels×four pixels shown in FIG. 3 in a longitudinal direction and a transverse direction.

First, the case in which the input data D [7 . . . 0]=00h (corresponding to "0" in FIG. 2) will be described. As shown in FIG. 2, when the input data D [7 . . . 0]=00h, FRC drive is carried out such that a gradation time average of the respective display pixels is gradation level 0. In this case, simply, as shown in FIG. 3, the gradation levels of all the display pixels of the unit of four pixels×four pixels are gradation level 0 in all the frames from the first frame to the eighth frame. By carrying out display drive in this way, a gradation time average among the eight frames is gradation level 0, which brings about a state in which the display of gradation level 0 is carried out such that the respective display pixels are in 8-bit gradation on average among the eight frames. Further, in this case, flicker is not brought about because the same display is carried out in all the frames.

Next, in the case in which the input data D [7 . . . 0] 04h, in the same way as in the case in which the input data D [7 . . . 0]=00h, FRC drive is carried out such that a gradation time average of the respective display pixels is gradation level 1. In this case, as shown in FIG. 3, the gradation levels of all the display pixels of the unit of four pixels×four pixels are gradation level 1 in all the frames from the first frame to the eighth frame. By carrying out display drive in this way, a gradation time average among the eight frames is gradation level 1, which brings about a state in which the display of gradation level 1 is carried out such that the respective display pixels are in 8-bit gradation on average among the eight frames. Further, in this case as well, flicker is not brought about because the same display is carried out in all the frames.

Here, in FIG. 3, when the input data D [7 . . . 0] is 00h or 04h, the same display is carried out from the first frame to the eighth frame. However, in reality, the polarity of a voltage applied to display pixels is reversed every frame. By carrying out such reversal drive, a DC voltage is not applied to a liquid crystal for a long time, so as to avoid causing deterioration of the liquid crystal. Note that the polarity reversal of a voltage applied to display pixels can be carried out by, for example, reversing the polarity (level) of a gradation voltage applied to display pixels every frame. Further, because a voltage applied to display pixels is a difference between a gradation voltage and a common voltage, the polarity (level) of the common voltage may be reversed every frame. Such polarity reversal of a voltage applied to display pixels every frame is carried out in the same way as in the cases in which the input data D [7 . . . 0]=01h, 02h, or 03h, which will be described hereinafter as well.

Next, the case in which the input data D [7 . . . 0]=02h will be described. When the input data D [7 . . . 0]=02h, FRC drive is carried out such that a gradation time average of the respective display pixels is gradation level 0.5. Namely, in this case, FRC drive is carried out such that, in each display pixel, gradation level 1 is displayed in four frames of the eight frames, and gradation level 0 is displayed in the remaining four frames, as shown in FIG. 3.

However, in this case, flicker is brought about if all of the display pixels are driven in a constant display pattern (such that all of the display pixels simultaneously switch between gradation level 0 and gradation level 1). Accordingly, in the present embodiment, the display drive is carried out such that the display of gradation level 0 and the display of gradation level 1 is in a checkered pattern in which the gradation levels of adjacent display pixels are different from one another in the small display area (two pixels×two pixels), and the display positions at which gradation level 0 is displayed and the display positions at which gradation level 1 is displayed in the checkered pattern are sequentially shifted from the first frame to the eighth frame as shown in FIG. 3.

That is, in the example shown in FIG. 3, when focusing attention on a certain display pixel, the gradation level of the display pixel is a repetition of 1→10→0→0 or 0→0→1→1. Therefore, a gradation time average for the pixel among the eight frames is 0.5. Further, because display positions of gradation level 0 are always adjacent to display positions of gradation level 1, and vice versa, both vertically and horizontally in the each of the frames, an average gradation level of each two pixels adjacent to one another in a longitudinal direction and a transverse direction is always 0.5. In accordance therewith, there is no case in which a user is made to feel flicker.

Next, the case in which the input data D [7 . . . 0]=01h (1 in FIG. 2) and the case in which the input data D [7 . . . 0]=03h (3 in FIG. 2) will be described.

First, when the input data D [7 . . . 0]=01h (=1), FRC drive is carried out such that a gradation time average of the respective display pixels is gradation level 0.25. That is, in this case, as shown in FIG. 3, FRC drive is carried out such that for each display pixel, gradation level 1 is displayed in only two frames among the eight frames (gradation level 0 is displayed in the remaining six frames). However, because flicker is brought about when all the display pixels are driven in a constant display pattern (such that all of the display pixels simultaneously switch between gradation level 0 and gradation level 1), in the present embodiment the display drive is carried out as described hereinafter, which makes it possible for a user not to feel flicker.

FIGS. 4A, 4B, and 4C are diagrams showing the concept of the display of gradation level 0 and gradation level 1 when the input data D [7 . . . 0]=01h.

FIG. 4A is a diagram showing gradation display in a unit of four pixels×four pixels when the input data D [7 . . . 0]=02h. In the case in which the input data D [7 . . . 0]=02h, display positions of the gradation level 1 and display positions of the gradation level 0 are arranged in a checkered pattern in a small display area (two pixels×two pixels) as shown in FIG. 4A. Here, when focusing attention on a small display area in the upper right for example (circled in FIG. 4A), because gradation level 1 and gradation level 0 are each displayed in two pixels in a checkered pattern in this small display area, an average gradation level of the small display area in the upper right is 0.5. This is true of the small display areas in the lower right, lower left, and upper left as well. Accordingly, the case in which the input data D [7 . . . 0]=02h can be thought to be substantially the same as a case in which four small display areas (each of two pixels×two pixels) whose average gradation levels are 0.5 are arrayed as shown in FIG. 4B. Considering the FRC drive with respect to each small display area in this way, in the case in which the input data D [7 . . . 0]=01h, small display areas whose gradation levels are 0.5 and small display areas whose gradation levels are 0 are arrayed in a checkered pattern as shown in FIG. 4C, thereby making it possible to set an average gradation level in units of four pixels×four pixels to be 0.25. Thereafter, provided that the display of gradation level 0 and the display of gradation level 0.5 in a small display area are sequentially shifted every frame, it is possible to carry out the display of gradation level 0.25.

By carrying out such display drive, with a gradation time average of the respective display pixels being 0.25, in every frame, in each of the small display areas of two pixels×two pixels, either: display positions of gradation level 0 and display positions of gradation level 1 are displayed in a checkered pattern, or only the small display area of two pixels×two pixels only displays gradation level 0. Therefore, there is no case in which a user is made to feel flicker at the time of FRC drive.

Note that, in the case of the input data D [7 . . . 0]=03h, it is only necessary to substitute gradation level 1 for gradation level 0 in the small display areas shown in FIG. 4C. In this manner, with a gradation time average of the respective display pixels being 0.75, in every frame, in each of the small display areas of two pixels×two pixels, either: display positions of gradation level 0 and display positions of gradation level 1 are displayed in a checkered pattern, or the small display area of two pixels×two pixels only displays gradation level 1. Therefore, there is no case in which a user is made to feel flicker at the time of FRC drive.

Next, a method for realizing FRC drive as described above with respect to FIG. 3 will be described.

Figure 5A:
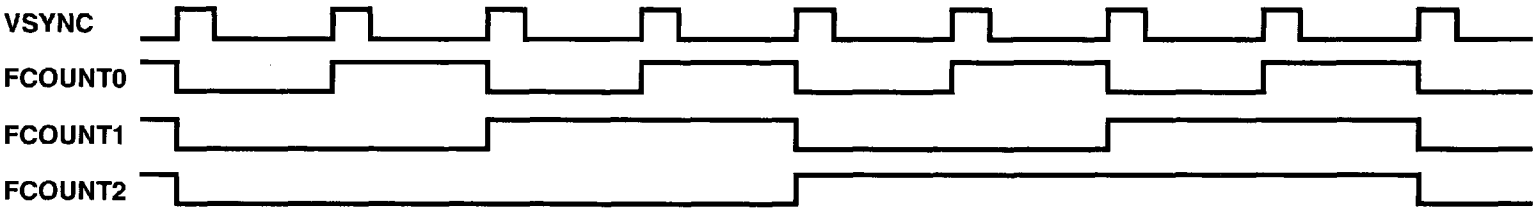
FIGS. 5A, 5B, and 5C are diagrams showing timing signals required for realizing the FRC drive in FIG. 3.
Figure 5B:
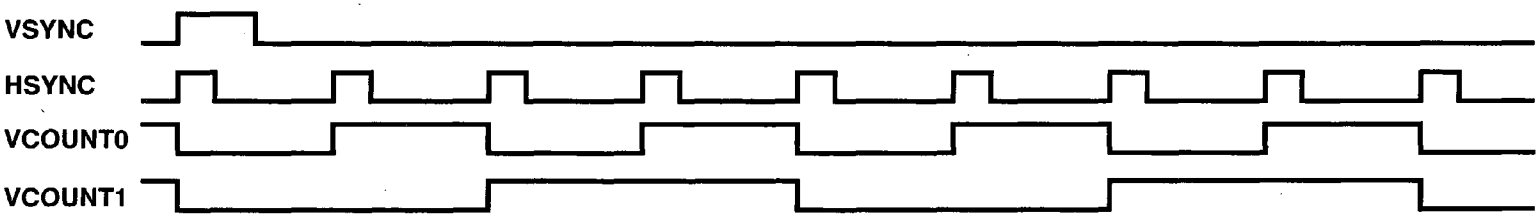
Figure 5C:
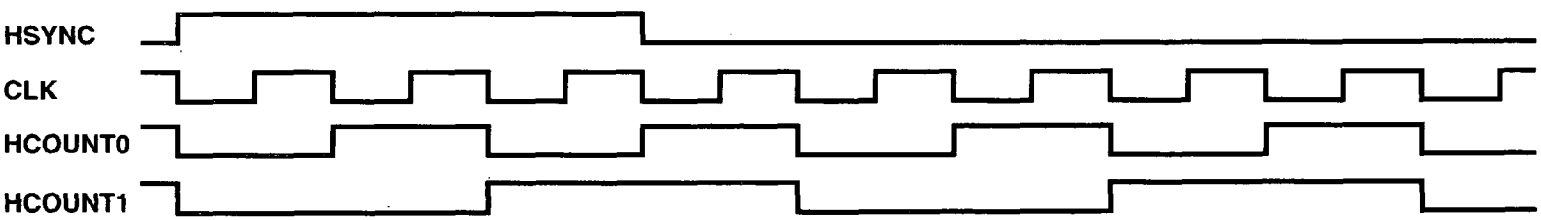

FIGS. 5A, 5B, and 5C are diagrams showing timing signals required for realizing FRC drive as described above with respect to FIG. 3.

As described above with respect to FIG. 1, in a display apparatus such as a liquid crystal display, display drive is generally carried out in accordance with a vertical synchronizing signal VSYNC, a horizontal synchronizing signal HSYNC, and a clock signal CLK. In the present embodiment, selection signals required for FRC drive are generated by counting these timing signals with a counter.

FIG. 5A is a timing chart showing a relationship between a vertical synchronizing signal and frame count signals outputted as counted results of the vertical synchronizing signal.

As shown in FIG. 5A, a frame count signal FCOUNT0 is a signal in which logical levels 0 and 1 are reversed every time the vertical synchronizing signal VSYNC is counted once (by an amount of one frame). In the same way, a frame count signal FCOUNT1 is a signal in which logical levels 0 and 1 are reversed every time the vertical synchronizing signal VSYNC is counted twice (by an amount of two frames), and a frame count signal FCOUNT2 is a signal in which logical levels 0 and 1 are reversed every time the vertical synchronizing signal VSYNC is counted four times (by an amount of four frames).

FIG. 5B is a timing chart showing a relationship among a horizontal synchronizing signal, a vertical synchronizing signal outputted as a counted result of the horizontal synchronizing signal, and vertical synchronizing signal count signals V.

As shown in FIG. 5B, a vertical synchronizing signal count signal VCOUNT0 is a signal in which logical levels 0 and 1 are reversed every time the horizontal synchronizing signal HSYNC is counted once (by an amount of one line). Further, a vertical synchronizing signal count signal VCOUNT1 is a signal in which logical levels 0 and 1 are reversed every time the horizontal synchronizing signal HSYNC is counted twice (by an amount of two lines).

FIG. 5C is a timing chart showing a relationship among a clock signal, a horizontal synchronizing signal outputted as a counted result of the clock signal, and horizontal synchronizing signal count signals.

As shown in FIG. 5C, a horizontal synchronizing signal count signal HCOUNT0 is a signal in which logical levels 0 and 1 are reversed every time the clock signal CLK is counted once (by an amount of one pixel). Further, a horizontal synchronizing signal count signal HCOUNT1 is a signal in which logical levels 0 and 1 are reversed every time the clock signal CLK is counted twice (by an amount of two pixels).

Figure 6:
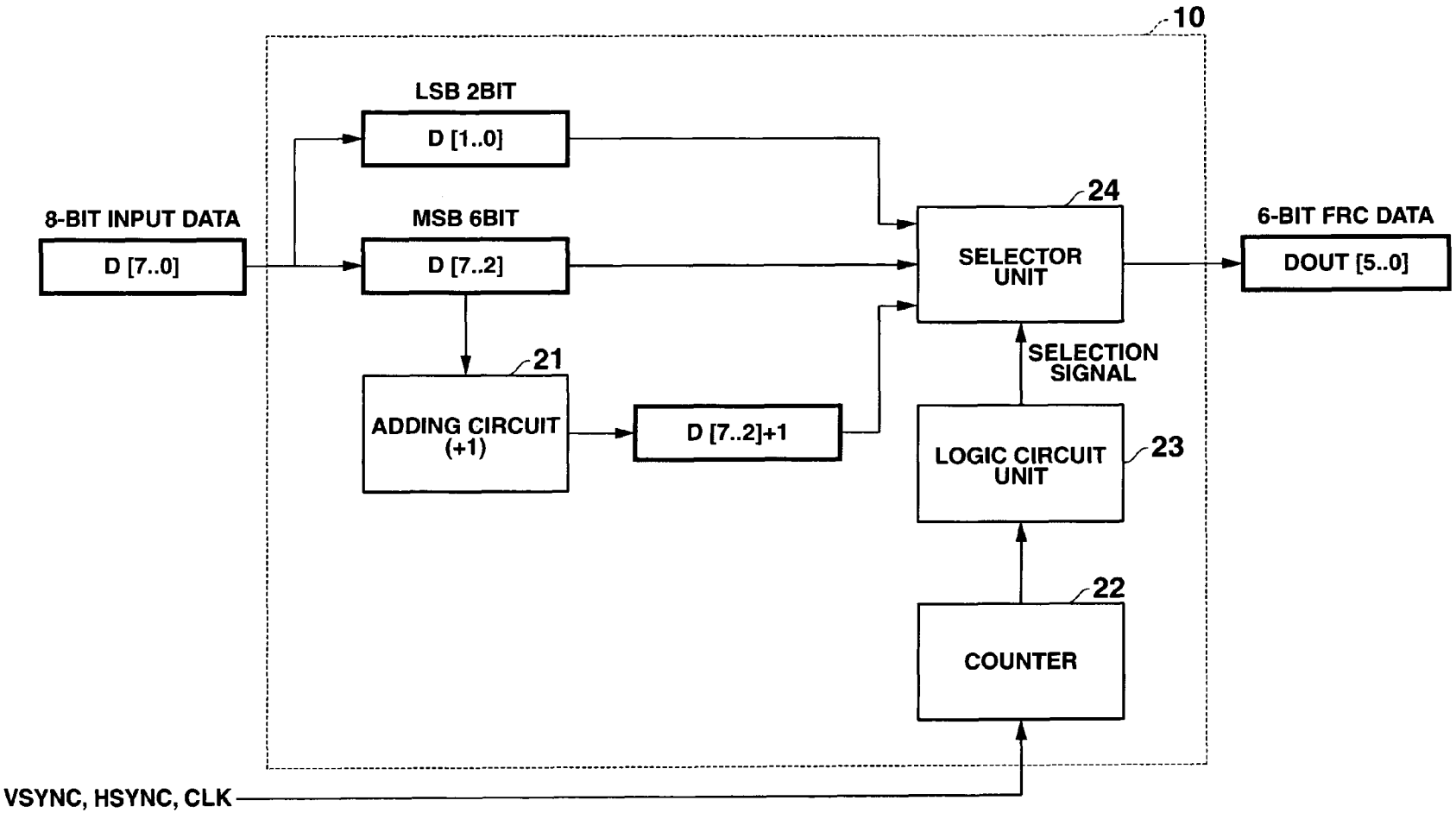
FIG. 6 is a diagram showing a detailed structure inside a data conversion unit of FIG. 1.

FIG. 6 is a diagram showing a detailed structure inside the data conversion unit 10 shown in FIG. 1.

When the 8-bit input data D [7 . . . 0] (first gradation data) are inputted to the data conversion unit 10, the input data D [7 . . . 0] are divided into the higher-order 6-bit data D [7 . . . 2] (second gradation data) and the lower-order 2-bit data D [1 . . . 0] (third gradation data). Then, the data D [7 . . . 2] are outputted to a selector unit 24 and an adding circuit 21, and the data D [1 . . . 0] are outputted to the selector unit 24. The adding circuit 21 generates data D [7 . . . 2]+1 (fourth gradation data) obtained by adding one to the data D [7 . . . 2] to be outputted to the selector unit 24.

For example, in the case of the input data D [7 . . . 0]=00h, the higher-order 6-bit data D [7 . . . 2]=000000 are inputted to the selector unit 24 and the adding circuit 21, and the lower-order 2-bit data D [1 . . . 0]=00 are outputted to the selector unit 24. In the case of the input data D [7 . . . 0]=01h, the higher-order 6-bit data D [7 . . . 2]=000000 are inputted to the selector unit 24 and the adding circuit 21, and the lower-order 2-bit data D [1 . . . 0]=01 are outputted to the selector unit 24. Further, in the case of the input data D [7 . . . 0]=02h, the higher-order 6-bit data D [7 . . . 2]=000000 are inputted to the selector unit 24 and the adding circuit 21, and the lower-order 2-bit data D [1 . . . 0]=10 are outputted to the selector unit 24. Moreover, in the case of the input data D [7 . . . 0]=03h, the higher-order 6-bit data D [7 . . . 2]=000000 are inputted to the selector unit 24 and the adding circuit 21, and the lower-order 2-bit data D [1 . . . 0]=11 are outputted to the selector unit 24. Still further, in the case of the input data D [7 . . . 0]=04h, the higher-order 6-bit data D [7 . . . 2]=000001 are inputted to the selector unit 24 and the adding circuit 21, and the lower-order 2-bit data D [1 . . . 0]=00 are outputted to the selector unit 24. As shown in this example, the input data [7 . . . 0]=00h, 01h, 02h, and 03h are data in which the higher-order 6 bits are the same and only the lower-order 2 bits are different from each other.

Then, in the present embodiment, the higher-order 6-bit data D [7 . . . 2] and D [7 . . . 2]+1 are used as the FRC data shown in FIG. 2 (which respectively correspond to n and n+1 in FIG. 2), and the lower-order 2-bits are used as data for identifying which FRC drive shown in FIG. 3 is to be carried out.

Further, the counter 22 counts a clock signal CLK, a horizontal synchronizing signal HSYNC, and a vertical synchronizing signal VSYNC in the way shown in FIGS. 5A to 5C, and outputs the respective counted results to the logic circuit unit 23 as the frame count signals FCOUNT0, FCOUNT1, and FCOUNT2, the vertical synchronizing signal count signals VCOUNT0 and VCOUNT1, and the horizontal synchronizing signal count signals HCOUNT0, and HCOUNT1.

In a general liquid crystal display, for example, there are cases in which a counter counting a clock signal CLK, a horizontal synchronizing signal HSYNC, a vertical synchronizing signal VSYNC, and the like is provided in order to generate various control signals. In that case, the function of a counter conventionally provided to a liquid crystal display may be used as the counter 22 in the present embodiment.

The logic circuit unit 23 generates selection signals from these count signals in accordance with a predetermined logic and outputs the selection signals to the selector unit 24.

The selector unit 24 receives a selection signal from the logic circuit unit 23 and selects one of the data D [7 . . . 2] and D [7 . . . 2]+1 in accordance with a value of the data D [1 . . . 0], and outputs the selected data as FRC data DOUT [5 . . . 0] to the display panel module 20.

The structure described above in which the higher-order 6-bit data D [7 . . . 2] and the lower-order 2-bit data D [1 . . . 0] are generated from the input data D [7 . . . 0], and in which the respective data are outputted to the selector unit 24, corresponds to the first gradation signal generating circuit of the present invention.

In addition, the structure in which the data D [7 . . . 2] are outputted to the adding circuit 21, and in which the data D [7 . . . 2]+1 generated by the adding circuit 21 adding one to the data D [7 . . . 2] are outputted to the selector unit 24, corresponds to the second gradation signal generating circuit of the present invention.

Still further, the structure in which one of the data D [7 . . . 2] and the data D [7 . . . 2]+1 is selected by the selector unit 24 to be outputted corresponds to the output circuit of the present invention.

And counter 22 and the logic circuit unit 23 correspond to the timing setting circuit of the present invention.

Figure 7:
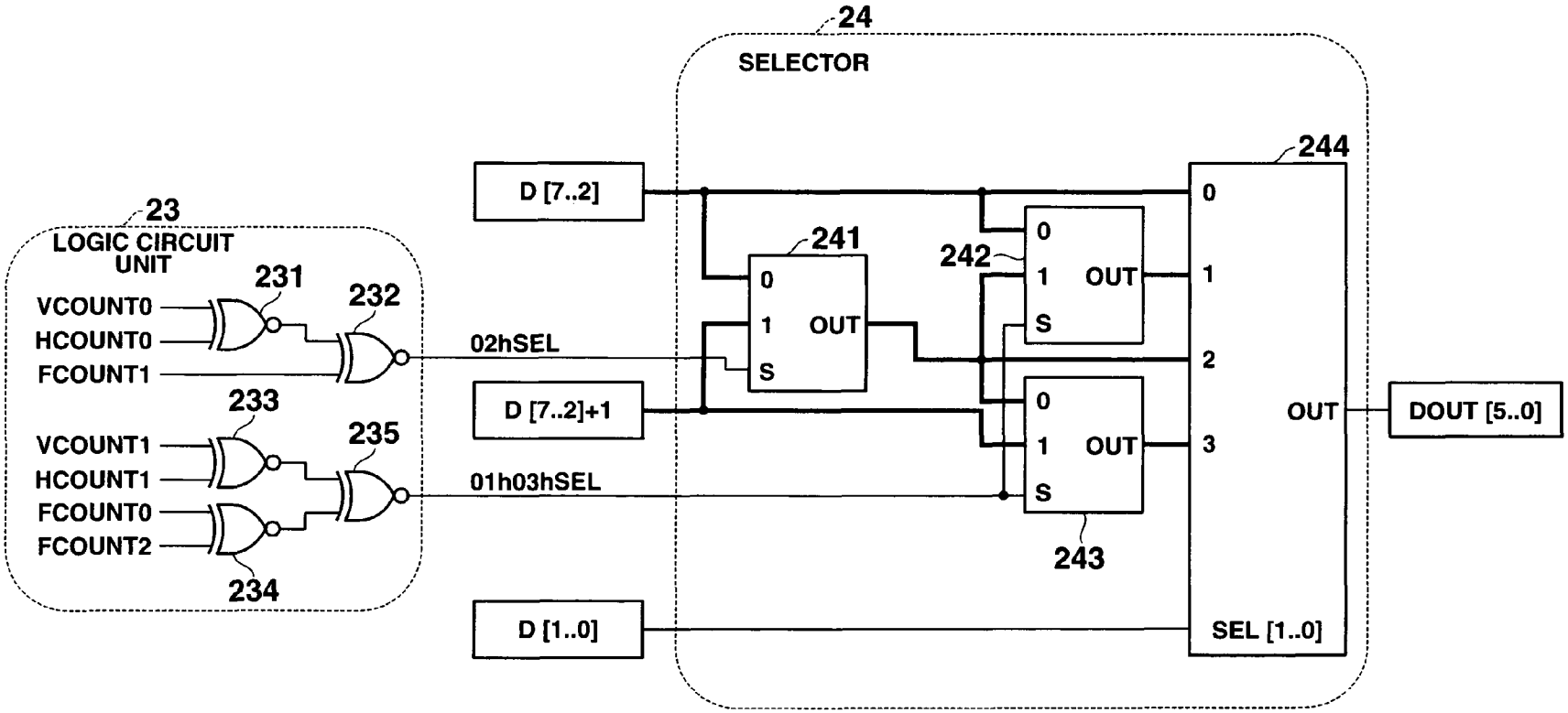
FIG. 7 is a diagram showing one example of concrete structures of a logic circuit unit and a selector.

FIG. 7 is a diagram showing one example of the concrete structures of the logic circuit unit and the selector.

The logic circuit unit 23 includes a circuit block for generating a selection signal 02hSEL for 02h, and a circuit block for generating a selection signal 01h03hSEL for 01h or 03h.

The circuit block for generating the selection signal 02hSEL for 02h includes an XNOR circuit 231 and an XNOR circuit 232. The signals VCOUNT0 and HCOUNT0 are inputted to the XNOR circuit 231, and outputs from the XNOR circuit 231 and the signal FCOUNT1 are inputted to the XNOR circuit 232.

On the other hand, the circuit block for generating a selection signal 01h03hSEL for 01h or 03h includes an XNOR circuit 233, an XNOR circuit 234, and an XNOR circuit 235. The signals VCOUNT1 and HCOUNT1 are inputted to the XNOR circuit 233, and the signals FCOUNT0 and FCOUNT2 are inputted to the XNOR circuit 234. Moreover, outputs from the XNOR circuit 233 and outputs from the XNOR circuit 234 are inputted to the XNOR circuit 235.

Further, the selector unit 24 includes selectors 241, 242, 243, and 244. The selector 241 selects the data D [7 . . . 2] when the selection signal 02hSEL is 0, and selects the data D [7 . . . 2]+1 when the selection signal 02hSEL is 1. The selector 242 selects the data D [7.2] when the selection signal 01h03hSEL is 0, and selects an output from the selector 241 when the selection signal 01h03hSEL is 1. The selector 243 selects an output from the selector 241 when the selection signal 01h03hSEL is 0, and selects the data D [7 . . . 2]+1 when the selection signal 01h03hSEL is 1. And the selector 244 selects the data D [7 . . . 2] when the data D [1 . . . 0] is 0, selects an output from the selector 242 when the data D [1 . . . 0] is 1, selects an output from the selector 241 when the data D [1 . . . 0] is 2, and selects an output from the selector 243 when the data D [1 . . . 0] is 3.

Hereinafter, operations of the selector unit 24 in FIG. 7 will be described.

First, when the input data D [7 . . . 0]=00h, the data D [7 . . . 2] is 0 (=000000), the data D [7 . . . 2]+1 is 1 (=000001), and the data D [1 . . . 0] is 0 (=00). In this case, the data D [7 . . . 2]=0 is selected by the selector 244 regardless of a state of a selection signal (02hSEL or 01h03hSEL). As a result, all the display pixels of the display panel module 20 are driven to display at gradation level 0.

Further, when the input data D [7 . . . 0]=02h, the data D [7 . . . 2] is 0 (=000000), the data D [7 . . . 2]+1 is 1 (=000001), and the data D [1 . . . 0] is 2 (=10). In this case, an output from the selector 241 is selected by the selector 244. This output from the selector 241 is determined depending on a state of the selection signal 02hSEL.

For example, when considering the four pixels×four pixels of the first frame, in the first line, 0 is inputted as the signal VCOUNT0, and 0 and 1 are alternately inputted to the XNOR circuit 231 as the signal HCOUNT0 every pixel. Therefore, the output from the XNOR circuit 231 is 1→0→1→0. Moreover, because the signal FCOUNT1 is 0, as a result, outputs from the XNOR circuit 232 (the selection signal 02hSEL) are 0→1→0→1. A selection by the selector 241 is carried out on the basis of the selection signal 02hSEL. Accordingly, the data DOUT [5 . . . 0] are outputted in the order of 0→1→0→1. In the second line, 0 and 1 are alternately inputted to the XNOR circuit 231 as the signal HCOUNT0 every pixel. On the other hand, 1 is inputted as the signal VCOUNT0 to the XNOR circuit 231. Therefore, outputs from the XNOR circuit 231 are 0→1→0→1. Moreover, because the signal FCOUNT1 is 0, as a result, outputs from the XNOR circuit 232 (the selection signal 02hSEL) are 1→0→1→0. The following third line is the same as the first line, and the fourth line is the same as the second line.

As described above, the four pixels×four pixels in the first frame are made to be those shown by 02h in FIG. 3. The process is performed in the same way for the following second frame. However, a voltage applied to the display pixels is made to have the reversed polarity of that of the first frame.

In the following third frame and fourth frame, because the signal FCOUNT1 is 1, outputs from the XNOR circuit 231

(the selection signals 02hSEL) are made to be those obtained by reversing the outputs in the first frame and second frame. Accordingly, the data DOUT [5 . . . 0] are outputted in the order of 1→0→1→0. Further, the following fifth frame to eighth frame is a repetition of the first frame to the fourth frame as shown in FIG. 3.

Further, in the case of the input data D [7 . . . 0]=01h or 03h, the data D [7 . . . 2] is 0 (=000000), the data D [7 . . . 2]+1 is 1 (=000001), and the data D [1 . . . 0] is 1 (=01) or 3 (=11). An output from the selector 242 is selected by the selector 244 when the data D [1 . . . 0] is 1, and an output from the selector 243 is selected by the selector 244 when the data D [1 . . . 0] is 3. These outputs from the selector 241 are determined depending on a state of the selection signal 01h03hSEL.

For example, when considering the four pixels×four pixels of the first frame, in the first line, 0 is inputted as the signal VCOUNT1, and 0 and 1 are alternately inputted as the signal HCOUNT1 to the XNOR circuit 231 every two pixels (that is, the signal HCOUNT 1 is 0→0→1→1 for the first four pixels—see FIG. 5C). Therefore, outputs from the XNOR circuit 233 are 1→1→0→0. Further, because the signal FCOUNT0 is 0 and the signal FCOUNT2 is also 0, outputs from the XNOR circuit 235 (the selection signal 01h03hSEL) are 1→1→0→0. A selection by the selector 242 or 243 is carried out on the basis of the selection signal 01h03hSEL. For example, when the data D [7 . . . 0]=01h, the data DOUT [5 . . . 0] are outputted in the order of 0→1→0→0 from the selector 244. In the same way, when the data D [7 . . . 0]=03h, the data DOUT [5 . . . 0] are outputted in the order of 1→1→0→1 from the selector 244.

In the second line, the signals HCOUNT1 and VCOUNT1 are the same as for the first line. However, in the second line, outputs from the selector 241 are 1→0→1→0. Accordingly, in the case of the data D [7 . . . 0]=01h, the data DOUT [5 . . . 0] are outputted in the order of 1→0→0→0 from the selector 244. In the same way, in the case of the data D [7 . . . 0]=03h, the data DOUT [5 . . . 0] are outputted in the order of 1→1→1→0 from the selector 244.

In the following third line, because the value of the signal VCOUNT1 is reversed, outputs from the XNOR circuit 233 are 0→0→1→1. Further, because the signal FCOUNT0 is 0, and the signal FCOUNT2 is also 0, outputs from the XNOR circuit 235 (the selection signal 01h03hSEL) are 0→0→1→1. Further, in the third line, outputs from the selector 241 are 0→1→0→1. Accordingly, when the data D [7 . . . 0]=01h, the data DOUT [5 . . . 0] are outputted in the order of 0→0→0→1 from the selector 244. In the same way, when the data D [7 . . . 0]=03h, the data DOUT [5 . . . 0] are outputted in the order of 0→1→1→1 from the selector 244.

The fourth line is the same as the third line except that outputs from the selector 241 are 1→0→1→0. Accordingly, when the data D [7 . . . 0]=01h, the data DOUT [5 . . . 0] are outputted in the order of 0→0→1→0 from the selector 244. In the same way, when the data D [7 . . . 0]=03h, the data DOUT [5 . . . 0] are outputted in the order of 1→0→1→1 from the selector 244.

As described above, the four pixels×four pixels in the first frame are made to be those shown by 01h and 03h in FIG. 3.

In the following second frame, because the signal FCOUNT0 is 1, outputs from the XNOR circuit 234 are 0. Moreover, in the third frame, the signal FCOUNT0 is 0, and the signal FCOUNT2 is 0. Further, in the fourth frame, the signal FCOUNT0 is 1, and the signal FCOUNT2 is 0. In the fifth frame, the signal FCOUNT0 is 0, and the signal FCOUNT2 is 1. Thereafter, because a value of the FCOUNT0 is reversed every frame, and a value of the FCOUNT2 is reversed every four frames, an output from the XNOR circuit 234 is changed and an output from the selector 244 is changed in accordance therewith. In this manner, it is possible to change a checkered pattern every frame in the relationship shown in FIG. 3.

Figure 13:
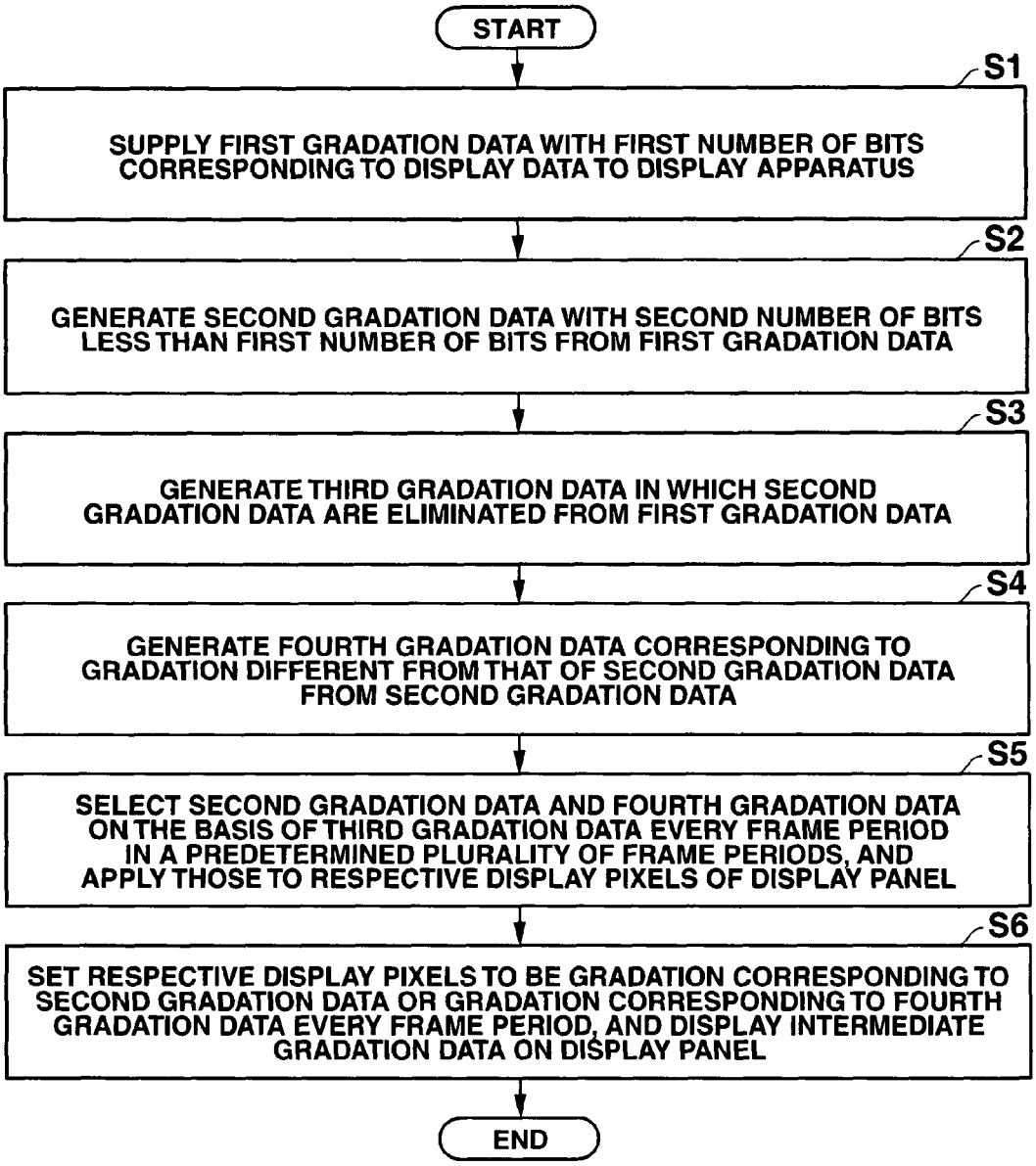
FIG. 13 is a flowchart for explaining a procedure for driving the display apparatus according to the present invention.

A procedure for driving the display apparatus including the display panel according to the present embodiment will be described below with reference to a flowchart of FIG. 13. First, first gradation data with a first number of bits corresponding to display data are supplied to the display apparatus (step S1). Next, second gradation data with a second number of bits, which is less than the first number of bits, are generated from the first gradation data (step S2). Thereafter, third gradation data in which the second gradation data are eliminated from the first gradation data are generated (step S3). Next, fourth gradation data corresponding to a gradation different from that of the second gradation data are generated from the second gradation data (step S4). Thereafter, the second gradation data and the fourth gradation data are selected on the basis of the third gradation data every frame period in a predetermined plurality of frame periods, and the selected data are applied to respective display pixels of the display panel (step S5). Next, the respective display pixels are set to be a gradation corresponding to the second gradation data or a gradation corresponding to the fourth gradation data every frame period, and an intermediate gradation between the second gradation data and the fourth gradation data is displayed on the display panel (step S6).

As described above, in accordance with the present embodiment, gradation display when the low-order 2 bits of input gradation data in which flicker is particularly easily brought about are 1 and 3 is carried out in a checkered pattern in which two pixels×two pixels are defined as one small display area, and the small display areas are arrayed in a checkered pattern, whereby it is possible to carry out a display to be 00h (0) and 02h (0.5), or 02h (0.5) and 04h (1). Accordingly, it is possible to prevent vertical and horizontal flicker in the screen with a time average of gradation levels per one cycle of the respective display pixels being a value of input gradation data.

Note that it goes without saying that the idea of FRC drive described above can be applied in the same way to the case in which the input data D [7 . . . 0] are 4n, 4n+1, 4n+2, and 4n+3 as well.

In addition, because one cycle is defined as 8 frames, there is no case in which a DC voltage is applied to a liquid crystal for a long time, and 8-bit gradation display is possible for every pixel.

Still further, in the present embodiment, the circuits for realizing gradation display in a checkered pattern may be simple circuits which merely count a clock signal, a vertical synchronizing signal, a horizontal synchronizing signal, and the number of frames, and generate selection signals corresponding thereto to be outputted by use of an adding circuit, a counter, a selector, and a logic circuit.

The present invention has been described above on the basis of the preferred embodiment. However, the present invention is not limited to the above-described embodiment, and of course various modifications and applications are possible within the scope of the present invention. For example, in the above-described embodiment, a small display area is defined as two pixels×two pixels. However, it may be defined as three pixels×two pixels as shown in FIG. 8. Provided that such three pixels×two pixels are set as a small display area, it is possible to carry out FRC drive so as to respectively allocate R, G, and B to the three pixels.

Further, in the present embodiment, the example in which the 8-bit gradation is displayed on the 6-bit display panel has been described. However, the embodiment can be applied to input data with another number of bits such as an example in which 6-bit gradation is displayed on a 4-bit display panel.

Further, it is possible to change the structure of the logic circuit unit 23 which generates selection signals for carrying out the selection of FRC data.

Figure 9:
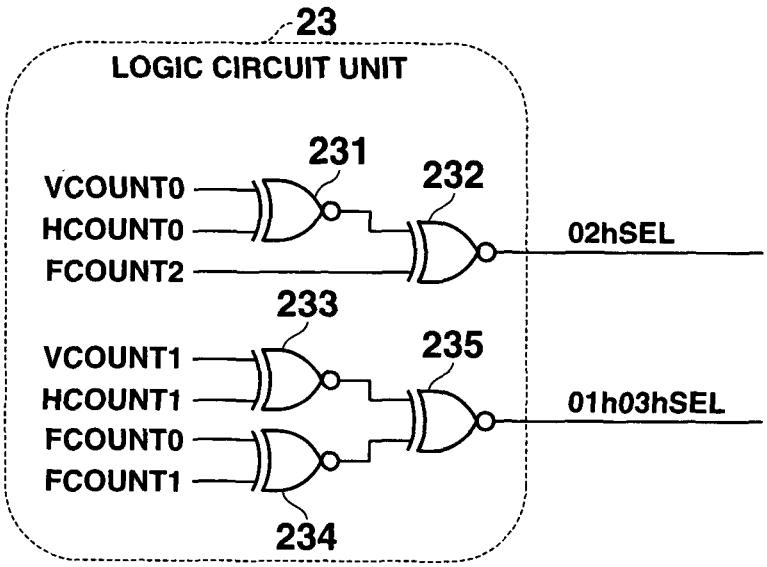
FIG. 9 is a diagram showing a structure of a first modification of the logic circuit unit.

For example, FIG. 9 is a diagram showing a structure of a first modification of the logic circuit unit, and FIG. 10 is a diagram showing a state of the gradation display in this case.

The first modification is an example in which the signals FCOUNT1 and the FCOUNT2 are replaced with one another in the structure of the logic circuit unit 23 in FIG. 7.

The gradation display in this case is carried out as shown in FIG. 10.

Figure 11:
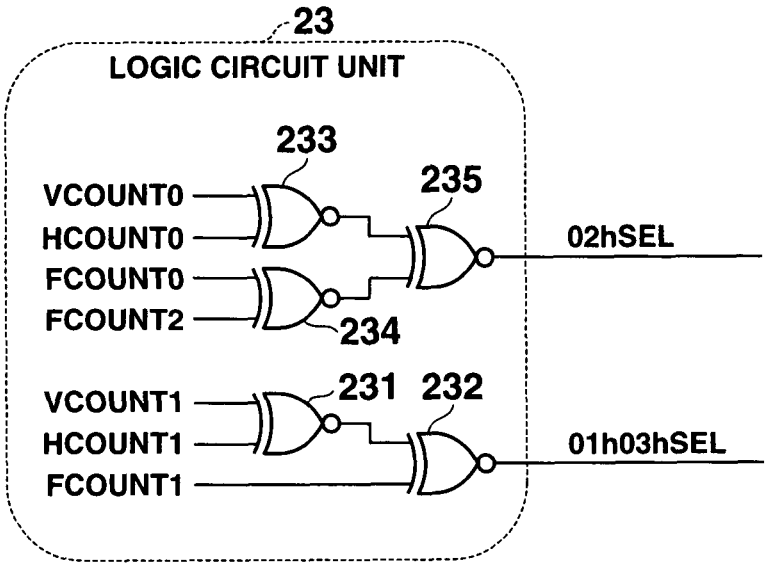
FIG. 11 is a diagram showing a structure of a second modification of the logic circuit unit.

Further, FIG. 11 is a diagram showing a structure of a second modification of the logic circuit unit, and FIG. 12 is a diagram showing a state of the gradation display in this case. The logic circuit unit 23 may be structured as shown in FIG. 11, and the gradation display in this case is carried out as shown in FIG. 12.

Moreover, inventions at different stages are included in the above-described embodiment, and various inventions can be considered to be the present invention by appropriately combining a plurality of the disclosed structural features. For example, even if some of the structural features are omitted from the structural features shown in the embodiment, as long as the problems described above can be solved and the effects described above can be achieved, the structure from which the structural features have been omitted can be considered to be the present invention.

What is claimed is:

1. A display drive apparatus which drives a display panel in which a plurality of display pixels are arrayed, comprising:

a first gradation signal generating circuit to which first gradation data with a first number of bits corresponding to display data are supplied, and which generates: (i) second gradation data with a second number of bits, which is less than the first number of bits, from the first gradation data, and (ii) third gradation data in which the second gradation data are eliminated from the first gradation data;

a second gradation signal generating circuit which generates, from the second gradation data, fourth gradation data corresponding to a gradation different from a gradation of the second gradation data; and an output circuit which, in each frame period of display by the display panel, selectively outputs one of the second gradation data and the fourth gradation data to each of the display pixels of the display panel based on the third gradation data, so as to cause an intermediate gradation between the second gradation data and the fourth gradation data to be displayed on the display panel;

wherein the output circuit includes a timing setting circuit which sets a number times of outputting the second gradation data and a number of times of outputting the fourth gradation data in a predetermined plurality of frame periods based on the third gradation data;

wherein the timing setting circuit divides said plurality of display pixels of the display panel into a plurality of small display areas each formed from a predetermined number of the display pixels adjacent to one another, and sets a pair of first small display areas facing each other diagonally and a pair of second small display areas facing each other diagonally, in the plurality of small display areas; and wherein the timing setting circuit sets all of the predetermined number of display pixels in each of the pair of first small display areas to be a gradation corresponding to one of the second gradation data and the fourth gradation data, and sets, in each of the pair of second small display areas, one of adjacent display pixels in the predetermined number of display pixels to be a gradation corresponding to the second gradation data, and the other of the adjacent display pixels to be a gradation corresponding to the fourth gradation data.

2. The display drive apparatus according to claim 1, wherein the second gradation data generated by the first gradation signal generating circuit are obtained by retrieving the second number of bits from upper bits of the first gradation data.

3. The display drive apparatus according to claim 1, wherein the second number of bits is less by two bits than the first number of bits.

4. The display drive apparatus according to claim 1, wherein the third gradation data generated by the first gradation signal generating circuit are obtained by retrieving a number of bits equal to a difference between the first number of bits and the second number of bits from lower bits of the first gradation data.

5. The display drive apparatus according to claim 1, wherein the fourth gradation data generated by the second gradation signal generating circuit have values obtained by adding one to the second gradation data.

6. The display drive apparatus according to claim 1, wherein the timing setting circuit includes:

a count circuit which counts a horizontal synchronizing signal, a vertical synchronizing signal, and a number of frame periods;

a selection signal generating circuit which generates and outputs a selection signal for selecting one of the second gradation data and the fourth gradation data based on the signals counted by the count circuit; and a selection circuit to which the selection signal is inputted, and which selects one of the second gradation data and the fourth gradation data based on the third gradation data in accordance with the selection signal.

7. The display drive apparatus according to claim 1, wherein the outputting of the second gradation data and the fourth gradation data by the output circuit is carried out per cycle of the predetermined plurality of frame periods, and a time average of gradations of each of the display pixels in the small display area during the cycle has a value corresponding to a corresponding gradation of the first gradation data.

8. The display drive apparatus according to claim 1, wherein the small display area is formed by two columns×two rows of the display pixels.

9. The display drive apparatus according to claim 1, wherein the small display area is formed by three columns× two rows of the display pixels.

10. The display drive apparatus according to claim 1, wherein the timing setting circuit sets respective layout positions of the pair of first small display areas and the pair of second small display areas to be switched by setting timings of outputting the second gradation data and the fourth gradation data.

11. A display apparatus which displays image information based on display data, comprising:

display means, comprising a display panel in which a plurality of display pixels are arrayed vertically and horizontally, for carrying out display by setting each of the display pixels to display a respective gradation corresponding to supplied gradation data;

a first gradation signal generating circuit to which first gradation data with a first number of bits corresponding to the display data are supplied, and which generates: (i) second gradation data with a second number of bits, which is less than the first number of bits, from the first gradation data, and (ii) third gradation data in which the second gradation data are eliminated from the first gradation data;

a second gradation signal generating circuit which generates, from the second gradation data, fourth gradation data corresponding to a gradation different from a gradation of the second gradation data; and an output circuit which, in each frame period of display by the display means, selectively outputs one of the second gradation data and the fourth gradation data to each of the display pixels of the display means as the supplied gradation data, based on the third gradation data, so as to set each of the display pixels to be one of a gradation corresponding to the second gradation data and a gradation corresponding to the fourth gradation data every frame period, so as to cause an intermediate gradation between the second gradation data and the fourth gradation data to be displayed on the display panel;

wherein the output circuit includes a timing setting circuit which sets a number times of outputting the second gradation data and a number of times of outputting the fourth gradation data in a predetermined plurality of frame periods based on the third gradation data;

wherein the timing setting circuit divides said plurality of display pixels of the display panel into a plurality of small display areas each formed from a predetermined number of the display pixels adjacent to one another, and sets a pair of first small display areas facing each other diagonally and a pair of second small display areas facing each other diagonally, in the plurality of small display areas; and wherein the timing setting circuit sets all of the predetermined number of display pixels in each of the pair of first small display areas to be a gradation corresponding to one of the second gradation data and the fourth gradation data, and sets, in each of the pair of second small display areas, one of adjacent display pixels in the predetermined number of display pixels to be a gradation corresponding to the second gradation data, and the other of the adjacent display pixels to be a gradation corresponding to the fourth gradation data.

12. The display apparatus according to claim 11, wherein the second gradation data generated by the first gradation signal generating circuit are obtained by retrieving the second number of bits from upper bits of the first gradation data.

13. The display apparatus according to claim 11, wherein the second number of bits is less by two bits than the first number of bits.

14. The display apparatus according to claim 11, wherein the third gradation data generated by the first gradation signal generating circuit are obtained by retrieving a number of bits equal to a difference between the first number of bits and the second number of bits from lower bits of the first gradation data.

15. The display apparatus according to claim 11, wherein the fourth gradation data generated by the second gradation signal generating circuit have values obtained by adding one to the second gradation data.

16. The display apparatus according to claim 11, wherein the display means includes a drive circuit which retrieves the second gradation data and the fourth gradation data supplied from the output circuit, and which applies corresponding gradation voltages to the display pixels of the display panel, and wherein the drive circuit has a structure corresponding to the second number of bits.

17. The display apparatus according to claim 11, wherein the timing setting circuit includes:

a count circuit which counts a horizontal synchronizing signal, a vertical synchronizing signal, and a number of frame periods;

a selection signal generating circuit which generates and outputs a selection signal for selecting one of the second gradation data and the fourth gradation data based on the signals counted by the count circuit; and a selection circuit to which the selection signal is inputted, and which selects one of the second gradation data and the fourth gradation data based on the third gradation data in accordance with the selection signal.

18. The display apparatus according to claim 11, wherein the outputting of the second gradation data and the fourth gradation data by the output circuit is carried out per cycle of the predetermined plurality of frame periods, and a time average of gradations of each of the display pixels in the small display area during the cycle has a value corresponding to a corresponding gradation of the first gradation data.

19. The display apparatus according to claim 11, wherein the small display area is formed by two columns×two rows of the display pixels.

20. The display apparatus according to claim 11, wherein the small display area is formed by three columns×two rows of the display pixels.

21. The display apparatus according to claim 11, wherein the timing setting circuit sets respective layout positions of the pair of first small display areas and the pair of second small display areas to be switched by setting timings of outputting the second gradation data and the fourth gradation data.

22. A method for driving a display apparatus which displays image information based on display data, wherein the display apparatus includes a display panel in which a plurality of display pixels are arrayed vertically and horizontally, the method comprising:

supplying first gradation data with a first number of bits corresponding to the display data to the display apparatus;

generating second gradation data with a second number of bits, which is less than the first number of bits, from the first gradation data;

generating third gradation data in which the second gradation data are eliminated from the first gradation data;

generating, from the second gradation data, fourth gradation data corresponding to a gradation different from a gradation of the second gradation data;

selecting, in each frame period of display by the display panel of a predetermined plurality of frame periods, one of the second gradation data and the fourth gradation data, and outputting the selected one of the second gradation data and the fourth gradation data to each of the display pixels of the display panel, based on the third gradation data; and setting, in each said frame period, each of the display pixels to be one of a gradation corresponding to the second gradation data and a gradation corresponding to the fourth gradation data, so as to display an intermediate gradation between the second gradation data and the fourth gradation data on the display panel;

wherein said outputting the selected one of the second gradation data and the fourth gradation data comprises:

dividing said plurality of display pixels of the display panel into a plurality of small display areas each formed from a predetermined number of the display pixels adjacent to one another, and setting a pair of first small display areas facing each other diagonally and a pair of second small display areas facing each other diagonally, in the plurality of small display areas;

setting all of the predetermined number of display pixels in each of the pair of first small display areas to be a gradation corresponding to one of the second gradation data and the fourth gradation data; and setting, in each of the pair of second small display areas, one of adjacent display pixels in the predetermined number of display pixels to be a gradation corresponding to the second gradation data, and the other of the adjacent display pixels to be a gradation corresponding to the fourth gradation data.

23. The drive method according to claim 22, wherein:

generating the second gradation data comprises retrieving the second number of bits from upper bits of the first gradation data, and generating the third gradation data comprises retrieving a number of bits equal to a difference between the first number of bits and the second number of bits from lower bits of the first gradation data.

24. The drive method according to claim 22, wherein the second number of bits is less by two bits than the first number of bits.

25. The drive method according to claim 22, wherein generating the fourth gradation data comprises adding one to the second gradation data.

26. The drive method according to claim 22, wherein said selecting of one of the second gradation data and the fourth gradation data to be applied to each of the display pixels of the display panel comprises:

counting a horizontal synchronizing signal, a vertical synchronizing signal, and a number of frames; and selecting one of the second gradation data and the fourth gradation data based on the counted signals; and wherein the selected data is outputted to the display panel.

27. The drive method according to claim 22, wherein said selecting of one of the second gradation data and the fourth gradation data to be applied to each of the display pixels of the display panel is carried out per cycle of the predetermined plurality of frame periods, and sets a time average of gradations of each of the display pixels in the small display areas during the cycle to a value corresponding to a corresponding gradation of the first gradation data.

28. The drive method according to claim 22, wherein said selecting of one of the second gradation data and the fourth gradation data to be applied to each of the display pixels of the display panel is performed so as to switch respective layout positions of the pair of first small display areas and the pair of second small display areas.

29. The display drive apparatus according to claim 1, wherein the timing setting circuit:

sets small display areas in the pair of first small display areas to be adjacent to each other in a first diagonal direction;

sets small display areas in the pair of second small display areas to be adjacent to each other in a second diagonal direction;

sets the first diagonal direction to intersect the second diagonal direction;

sets one of the pair of first small display areas to be adjacent to one of the pair of second small display areas in a columnar direction, and to be adjacent to the other of the second pair of small display areas in a row direction; and sets the other of the pair of first small display areas to be adjacent to the other of the pair of second small display areas in the columnar direction, and to be adjacent to the one of the pair of second small display areas in the row direction.

30. The display drive apparatus according to claim 11, wherein the timing setting circuit:

sets small display areas in the pair of first small display areas to be adjacent to each other in a first diagonal direction;

sets small display areas in the pair of second small display areas to be adjacent to each other in a second diagonal direction;

sets the first diagonal direction to intersect the second diagonal direction;

sets one of the pair of first small display areas to be adjacent to one of the pair of second small display areas in a columnar direction, and to be adjacent to the other of the second pair of small display areas in a row direction; and sets the other of the pair of first small display areas to be adjacent to the other of the pair of second small display areas in the columnar direction, and to be adjacent to the one of the pair of second small display areas in the row direction.

31. The drive method according to claim 22, wherein said setting the pair of first small display areas and the pair of second small display areas comprises:

setting small display areas in the pair of first small display areas to be adjacent to each other in a first diagonal direction;

setting small display areas in the pair of second small display areas to be adjacent to each other in a second diagonal direction;

setting the first diagonal direction to intersect the second diagonal direction;

setting one of the pair of first small display areas to be adjacent to one of the pair of second small display areas in a columnar direction, and to be adjacent to the other of the second pair of small display areas in a row direction; and setting the other of the pair of first small display areas to be adjacent to the other of the pair of second small display areas in the columnar direction, and to be adjacent to the one of the pair of second small display areas in the row direction.

* * * * *

UNITED STATES PATENT AND TRADEMARK OFFICE

CERTIFICATE OF CORRECTION

PATENT NO. : 8,531,490 B2
APPLICATION NO. : 11/827753
DATED : September 10, 2013
INVENTOR(S) : Takahiro Harada It is certified that error appears in the above-identified patent and that said Letters Patent is hereby corrected as shown below:

In the Claims

In Column 13, Line 54, (Claim 1, Line 23):

delete “number times” and insert --number of times--.

In Column 15, Line 24:

delete “number times” and insert --number of times--.

In Column 18, Line 17:

after “display” delete “drive”.

Signed and Sealed this
Twenty-first Day of October, 2014

Michelle K. Lee

Michelle K. Lee
*Deputy Director of the United States Patent and Trademark Office*